US005823751A

United States Patent [19]

Sjoblom et al.

[11] Patent Number: 5,823,751

[45] Date of Patent: Oct. 20, 1998

[54] MOUNTING DEVICE FOR SUBMERSIBLE ELECTRIC MOTOR DRIVEN PUMP

[75] Inventors: Torbjorn Sjoblom, Johanneshov; Bjorn Unden, Solna, both of Sweden

[73] Assignee: ITT Flygt AB, Solna, Sweden

[21] Appl. No.: 731,041

[22] Filed: Oct. 8, 1996

[51] Int. Cl.[6] ..... F04B 39/06

[52] U.S. Cl. ..... 417/360; 417/366; 417/423.3

[58] Field of Search ..... 417/360, 366, 417/368, 423.3

[56] References Cited

U.S. PATENT DOCUMENTS 3,153,382 10/1964 Van Blancom ..... 417/423.3
3,601,498 8/1971 Schroeder ..... 417/360 X
4,324,532 4/1982 Knife ..... 417/360
5,055,006 10/1991 Kobayashi et al. ..... 417/366

*Primary Examiner*—Richard E. Gluck
*Attorney, Agent, or Firm*—Menotti J. Lombardi

[57] ABSTRACT

The invention concerns a device for mounting and keeping together parts in a submersible pump unit.

Two groups of screw joints (15) and (16) respectively are alternatively arranged around the periphery of the pump unit, the first group of said joints (15) connectings the stator housing (8) and the seal housing (4) via a ring (13), while the other group of joints (16) connect said ring (13), said pump housing (5) and a cooling jacket (10) surrounding said stator housing (8).

2 Claims, 2 Drawing Sheets

MOUNTING DEVICE FOR SUBMERSIBLE ELECTRIC MOTOR DRIVEN PUMP

BACKGROUND OF THE INVENTION

The invention concerns a device for mounting and keeping a submersible pump unit together.

A machine of this type normally comprises an electrically driven motor and a hydraulic unit with a rotating impeller connected to the motor via a driving shaft.

In order to prevent the medium within the hydraulic part from penetrating the electric motor via the shaft, one or several seals are arranged between the hydraulic part and the motor. One common type of seal is the so-called mechanical face seal which comprises one seal ring rotating with the shaft and one stationary seal ring in the surrounding pump housing. The two seal rings are pressed towards each other by help of spring force thus preventing liquid from penetrating between the rings.

In order to secure a sufficient sealing there are normally two mechanical seals arranged in a seal housing containing oil for lubricating and cooling of the seal surfaces.

In order to obtain a good cooling of the electric motor, it is common to let the pumped medium, water, flow through a cooling jacket surrounding the motor on its way towards the outlet.

A pump unit of the above described type will thus comprise an electric motor having a surrounding cooling jacket, a seal housing and a pump housing connected via a rotating driving shaft.

In order to keep the different parts in a package there are several different solutions. By big machines it is common to provide the different parts with flanges and attach said flanges by help of bolts around the peripheries. By smaller machines it is common to arrange a few long bolts around the periphery which press the outer parts towards each other, thus locking the intermediate part therebetween.

Solutions of the above described type are shown in SE 414 696 and DE 1653 726.

SUMMARY OF THE INVENTION

A disadvantage with the solutions described above is that they are expensive as regards the material as well as the necessary mounting time. It has therefor been desired to obtain a construction that is inexpensive to manufacture and easy to mount, especially for smaller pumps where the cost is very important. This problem has been solved in an effective way by help of the device according to the invention.

BRIEF DESCRIPTION OF THE DRAWINGS

The invention is described more closely below with reference to the enclosed drawings.

DESCRIPTION OF THE PREFERRED EMBODIMENT

Figure 1:
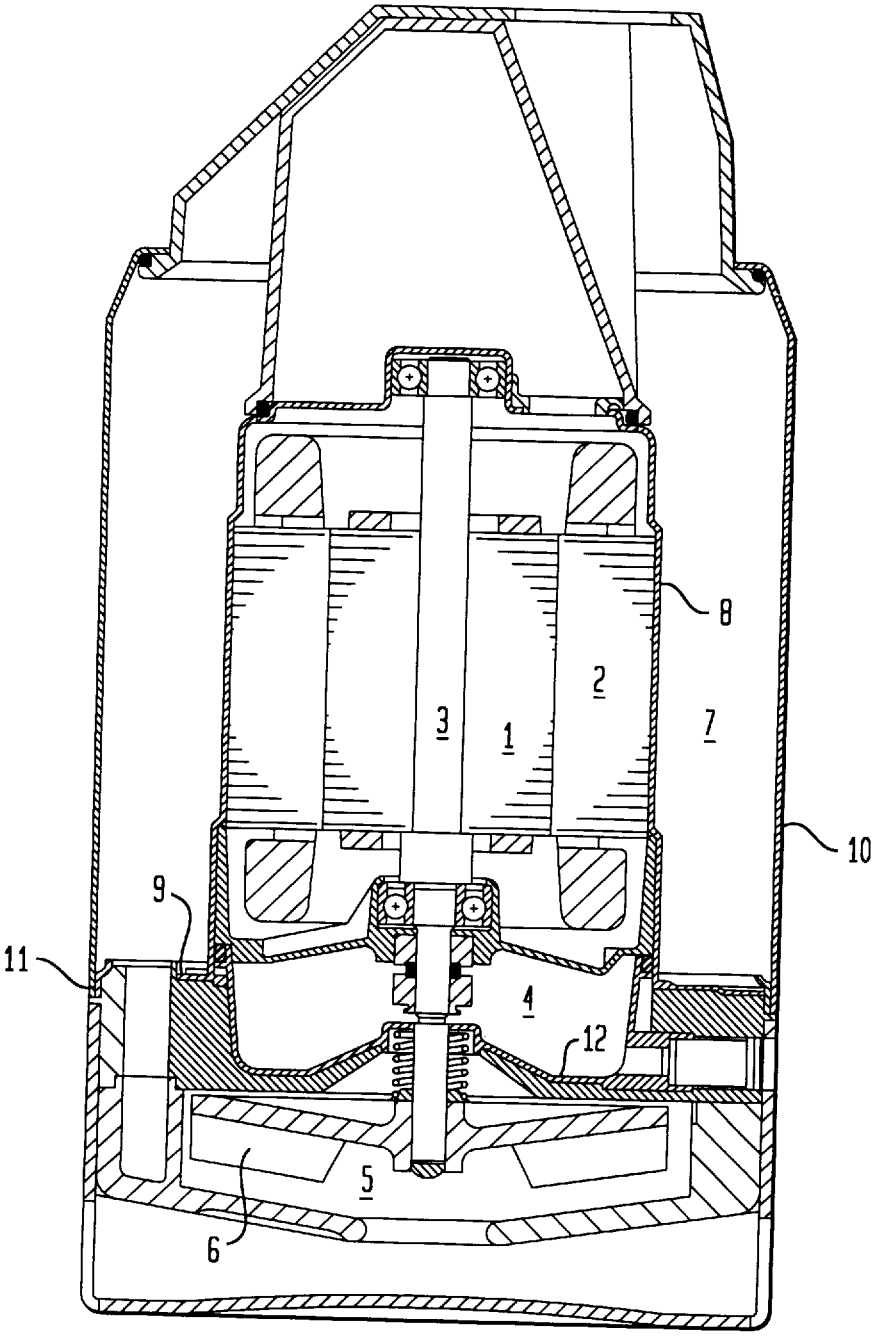
FIG. 1 shows a cut through a pump mounted according to the invention.
Figure 2:
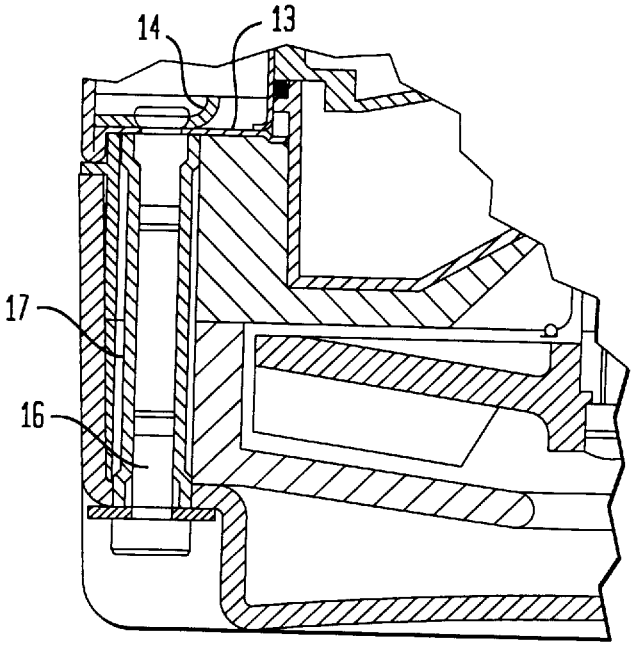
FIGS. 2 and 3 show enlarged details of the pump in two differently by turned cuts.
Figure 3:
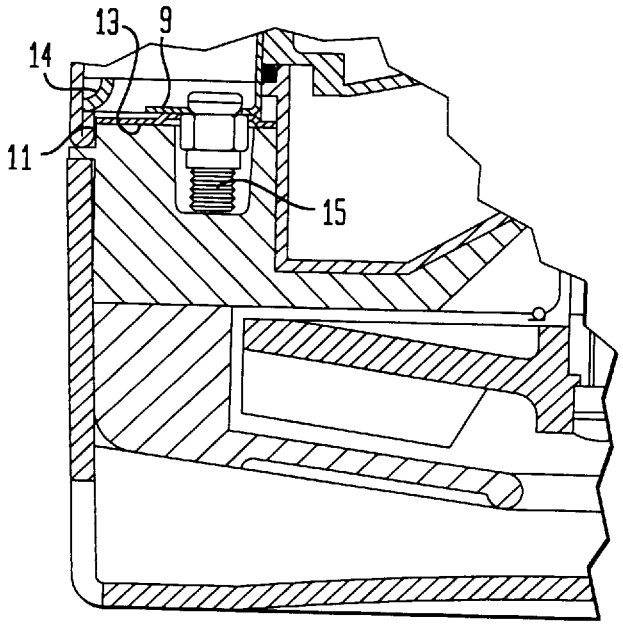

In the drawings 1 and 2 stand for the rotor and the stator, respectively, in an electric motor. 3 stands for a driving shaft, 4 a seal housing, 5 a pump housing with impeller 6, 7 a cooling channel, 8 a stator housing, 9 a flange or ear on the stator housing, 10 a cooling jacket, 11 an edge folding on the jacket 10, 12 the bottom of the oil housing, 13 and 14 rings, 15 and 16 screw joints and 17 a hole in the pump housing 1.

As previously mentioned the pump unit comprises the three main parts motor, seal housing and pump housing which are kept together in a simple and secure way which is also easy to mount.

According to the invention two groups of screw joints 15 and 16 respectively are used, which joints are arranged alternatively around the periphery of the pump unit on a level with the seal housing 4. The number of joints may vary but at least three of each group is to prefer in order to obtain a sufficient security.

The joints 15 in one of the groups join a number of lugs 9, which extend outwards from the lower edge of the stator housing 8 and a ring 13 arranged under a flange on the bottom 12 of the seal housing 4. In this way the stator housing 8 and the seal housing are connected to each other.

The joints 16 in the other group of joints join said ring 13 and an edge folding 11 on the end of the cooling jacket 10 heading the pump housing 5 via an additional ring 14. Said two rings 13 and 14 are now fixed relative each other. As the ring 13 abuts the seal housing 4 on the under side and the ring 14 abuts the edge folding 11 on the upper side, the consequence is that the motor and seal housing are rigidly attached to each other.

Finally the joints 16 in the second group of joints are arranged in a conventional way in holes 17 along the periphery of the pump housing 5 an thereby all parts, motor, seal housing and pump housing are attached to each other.

By help of the invention a very simple reliable and a easy-to mount connection of the main parts in a pump unit is obtained. Demounting is correspondingly easy.

We claim:

1. A device for mounting and keeping the parts of a submersible pump unit together, comprising in combination:

an electric motor having a rotor (1) with a shaft (3), and a stator (2), and stator housing (8) surrounded by a cooling jacket (10);

a pump housing (5) having an impeller (6) coupled to said shaft (3), and a seal housing (4) positioned between said stator housing (8) and said pump housing (5);

a first group of screw joints (15) and a second group of screw joints (16) being, alternately arranged around the periphery of the pump unit on a level with said seal housing (4);

a ring (13) being arranged around the seal housing (4) to enable said first group of joints (15) to maintain said stator housing (8) and said seal housing (4) together;

said second group of joints (16) maintaining together said seal ring (13), said pump housing (5), and an end of the cooling jacket (10) that abuts the pump housing (5); and said stator housing (8) having outwardly directed ears (9) which cooperatively engage said joints (15).

2. The device according to claim 1 wherein said end of said cooling jacket (10) that abuts said pump housing (5) having a radially directed edge folding (11) which supports a second ring (14), and said second ring (14) cooperatively engage said joints (16).

* * * * *